United States Patent [19]

Kranz

[11] Patent Number: 4,925,130

[45] Date of Patent: May 15, 1990

[54] FLIGHT PATH CONTROL APPARATUS FOR MISSILES

[75] Inventor: Walter Kranz, Taufkirchen, Fed. Rep. of Germany

[73] Assignee: Messerschmitt-Bölkow-Blohm, Munich, Fed. Rep. of Germany

[21] Appl. No.: 345,992

[22] Filed: May 2, 1989

[30] Foreign Application Priority Data

May 5, 1988 [DE] Fed. Rep. of Germany ..... 3815290

[51] Int. Cl.[5] ..... F42B 15/027; F41G 7/00

[52] U.S. Cl. ..... 244/3.21

[58] Field of Search ..... 244/3.17, 3.21

[56] References Cited

U.S. PATENT DOCUMENTS

| | | | |
|---|---|---|---|
| 2,594,766 | 4/1952 | Goddard | 244/3.21 |
| 3,262,655 | 7/1966 | Gillespie, Jr. | 244/3.21 |
| 4,399,962 | 8/1983 | Wedertz et al. | 244/3.23 |
| 4,579,298 | 4/1986 | Thompson | 244/3.21 |
| 4,793,571 | 12/1988 | Kranz | 244/3.21 |

FOREIGN PATENT DOCUMENTS

| | | | |
|---|---|---|---|
| 3503041 | 9/1986 | Fed. Rep. of Germany | 244/3.21 |
| 3628152 | 9/1987 | Fed. Rep. of Germany | 244/3.21 |

*Primary Examiner*—Charles T. Jordan

*Attorney, Agent, or Firm*—Kenyon & Kenyon

[57] ABSTRACT

An apparatus for changing the flight path of a missile is disclosed. The apparatus comprises the tip of the missile which is installed so as to be pivotable in the nose of the missile and at least one actuator to tilt the pivotable nose cone. One end of the actuator is coupled to the internal outer edge of the nose cone and the other end of the actuator is coupled internally within the main missile body. The outer wall of the forward part of the missile additionally contains at least one annular flexible element extending perpendicularly to the axis of the missile body which facilitates the tilting of the nose cone.

13 Claims, 3 Drawing Sheets

FIG. 2
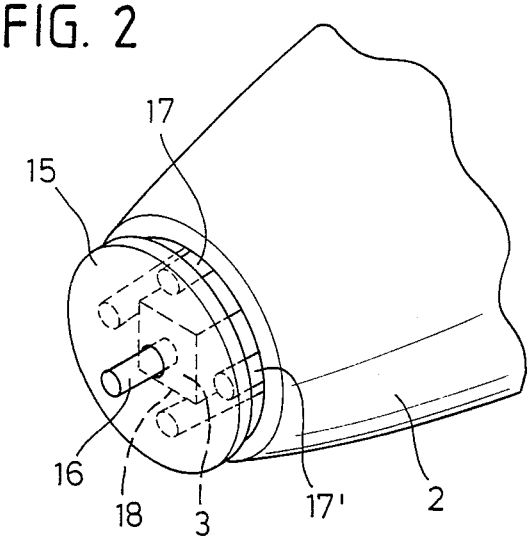
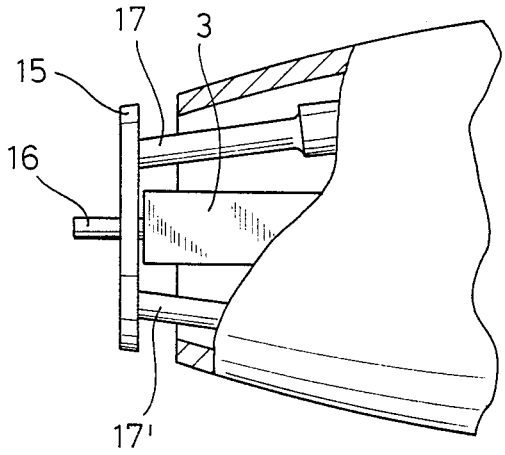
FIG. 3

FLIGHT PATH CONTROL APPARATUS FOR MISSILES

FIELD OF THE INVENTION

This invention relates to the field of devices for controlling the flight path of flying objects. More specifically, it is an apparatus for controlling the flight path of a missile, rocket or artillery shell, by adjusting the position of the object's forward facing section with respect to the forward flight direction.

BACKGROUND OF THE INVENTION

Active control of missiles, both ballistic and guided, is required for both stabilization of the missile during its flight and guidance of the missile towards a predetermined target. U.S. Pat. No. 4,399,962 discloses one method to provide this stabilization and guidance. In the '962 reference, the missile is provided with an articulated nose cone, which nose cone is locked in place at the start of the missile's flight. A number of pyrotechnically operable cylinders are located in the tip of the missile, whose exhaust is directed perpendicular to the missile's longitudinal axis. Each of the cylinders is addressed and triggered separately by a central electronic means. If the missile's flight path deviates from the desired course, the tip of the missile is unlocked and the appropriate cylinder is triggered, the exhaust from the cylinder tilting the missiles's tip in the desired direction. The asymmetical nose in turn produces asymmetrical aerodynamic forces which alter the missile's flight path. A problem arises in that, in order to counteract or cancel the 29 first correction, the missile must be rotated 180° and a cylinder opposite the previously triggered cylinder must be fired, to return the missile to symmetric flight conditions. This type of flight path control apparatus tends to be very complicated. It is also only suitable for use in spin-stabilized missiles, as the cylinders which bring about the course correction fire only perpendicularly to the flight direction.

It is an object of the present invention to provide a simple and reliable device for changing the flight path of a missile which may or may not be spin-stabilized. The device can not only change the course of a spin-stabilized missile but can also stabilize a non-rolling missile as well as alter that missile's course.

SUMMARY OF THE INVENTION

This object and other objects are achieved in the present invention by coupling at least one actuator to a pivotable nose cone or tip of a missile, the opposite end of the actuator being anchored in the main body of the missile. Preferably, between the moveable nose cone and the main body of the missile, there is at least one flexible annular element adhering respectively and simultaneously to both the nose cone and main body.

In a first embodiment, the nose cone is mounted on a pivot and is capable of motion in only one plane. The nose cone is then coupled to one or more actuators arranged symmetrically in the main body, the actuators being mounded on tubular springs.

In another embodiment, the nose is coupled to the main body by means of a ball joint, so that it can be tilted in any desired plane. The number of actuators coupled to the nose cone varies with how many axes of control are desired.

In either case, the actuators may be hydraulic, pneumatic or electric. The nose cone itself may be equipped with a sensor for measuring the angle of attack.

In yet another embodiment, the nose cone may be a flat disc mounted to the missile's main body on a support with a ball joint. Actuators are then coupled to the edge of the disc in the same manner as with a more streamlined nose cone.

One of the advantages inherent in all these embodiments is that only the very tip of the missile, namely its nose cone, is tilted relative to the longitudinal axis of the missile so only a small mass must be moved. As the tilting of the nose cone causes the rest of the missile to follow the new course by means of acrodynamic amplification, this method uses considerably less power for stabilizing and controlling the missile than that employed in the '962 patent, where the entire body of the missile is tilted by use of the cylinders.

If the missile is not roll-stabilized, several actuators are necessary to tilt the nose cone. If the missile is roll-stabilized, only one actuator, controlled in a pulse-like fashion, is needed to effect course changes.

These and other objects and advantages of the invention will appear more clearly from the following specification in connection with the accompanying drawings, in which:

BRIEF DESCRIPTION OF THE DRAWINGS:

FIG. 2 is a perspective view of a second embodiment of the present invention; and FIG. 3 is a partial section of the second embodiment of the present invention.

DETAILED DESCRIPTION

Figure 1:
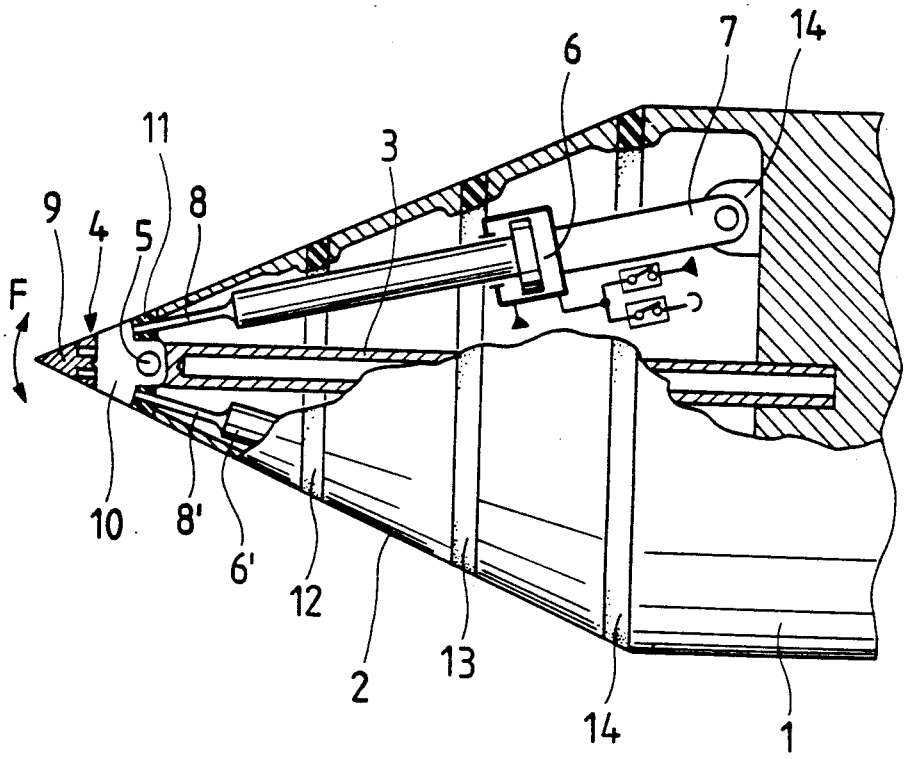
FIG. 1 is a partial section through a missile containing a first embodiment of the present invention.
Figure 1A:
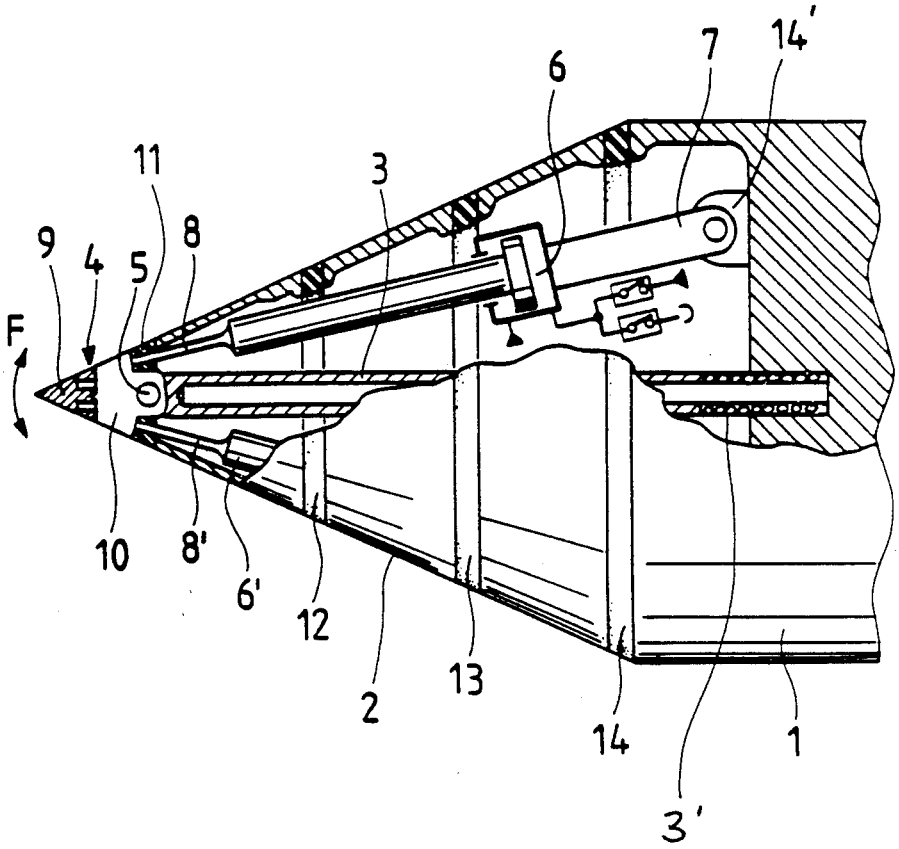
FIG. 1A is a partial section view of a missile containing a modified form of the first embodiment of the present invention.

As shown in FIG. 1, nose cone 4 is mounted on forward missile body structure 2. The forward missile body structure 2 is in turn mounted on missile main body 1. In particular, nose cone 4 is mounted so that it can pivot on top of a connecting part 3, which connecting part extends along the missile's longitudinal axis. The connecting part can be a tubular spring or a rod linked to a tubular spring. FIG. 1 shows an embodiment wherein part 3 is a tubular spring and FIG. 1A shows an embodiment wherein a rod 3 is coupled through a tubular spring 3.

Nose cone 4 is connected at its longitudinal center by means of pivot 5 to connecting piece 3. Actuators 6 and 6' are in turn coupled at ends 8 and 8' to nose cone 4 at the nose cone's outer edge. The actuators, as seen in FIG. 1, are mounted at an angle relative to the missile's longitudinal axis. The other ends of the actuators are attached to main body 1 by means of a suitable connecting point 14'.

The outer wall of the forward missile body structure can be comprised of several annular flexible elements 11, 12, 13 and 14 arranged spaced apart from one another along the missile's longitudinal axis. The elements facilitate the tilting of nose cone 4 and, thereby, the deformation of the forward missile body structure 2.

The embodiment of the present invention shown in FIG. 1, which uses two actuators 6 and 6' and single plane pivot 5, is well suited for roll-stabilized missiles. Tilting of the nose cone 4 in plane F occurs when the nose cone occupies the correct position relative to the drawing. Extending the movable part of actuator 6, which in turn compresses the movable part of actuator 6', tilts nose cone 4 downward. The flexible element 11 located on the side of the missile towards which the nose cone is tilting is thereby compressed, while the section on the opposite side is somewhat extended. This process causes a non-uniform flow of air against the tip of the missile supporting the tilting of the forward body structure 2 whereby the other flexible elements 12, 13 and 14 are compressed and extended in the same manner like element 11. Once the missile returns to the desired flight path, the tilting of the nose cone is reversed by commands reversing the movement of the actuators. These double-action actuators can be operated hydraulically, pneumatically, electrically or piezoelectrically.

Nose cone 4 can be equipped with pressure sensor 9 for measuring the missile's angle of attack. This would make possible active aerodynamic body stabilization at the tip of the missile. It can further be provided with an optical sensor or laser detector sensor for receiving external signal sources. The nose cone of the missile acts as the overall flight path change initiator It in turn leads to the aerodynamic amplification of the flight path change command by deforming the forward missile body structure 2.

The embodiment of the present invention shown in FIGS. 2 and 3 replaces the truncated nose cone of FIG. 1 with a flat disc 15. The flat disc is particularly well suited for generating asymmetrical shock waves and thereby generating a transverse force. Disc 15 is linked to connecting part 3 by pin 16 coupled to the disc center. The edges 18 of square connecting piece 3 assist in the tilting of disc 15 by providing pivoting edges. The actual pivoting is done by actuation of actuators 17 and 17', which are coupled to both the edge of the disc and the missile's main body. Pin 16 is rigidly coupled to the disc and the actuators act additionally as flexible supports for the disc's outer edge.

In the foregoing specification, the invention has been described with reference to specific exemplary embodiments thereof It will, however, be evident that various modifications and changes may be made thereunto without departing from the broader spirit and scope of the invention as set forth in the appended claims. The specification and drawings are, accordingly, to be regarded in an illustrative rather than in a restrictive sense.

I claim:

1. Apparatus for changing the flight path of a missile having a main body and a forward missile body structure coupled ahead of the main body comprising:

nose cone means coupled to the forward missile body structure and capable of pivoting in at least one plane;

actuator means coupled to the main body and to the nose cone means, capable of tilting the nose cone means about the at least one plane; and a plurality of annular flexible element means located between the nose cone means and the main body and being disposed at spaced intervals in the forward missile body structure to allow deformation of said forward missile body structure upon tilting of said nose cone means.

2. The apparatus of claim 1 comprising connecting means having first and second ends, the first end fixed to the main body at the longitudinal axis of the main body and the second end fixed to the nose cone means.

3. The apparatus of claim 2 wherein the connecting means is a tubular spring.

4. The apparatus of claim 2 wherein the connecting means is a rod supported on a tubular spring.

5. The apparatus of claim 1 wherein the nose cone means can be pivoted in one plane and the actuator means is arranged symmetrically about the longitudinal axis of the main body.

6. The apparatus of claim 2 wherein the nose cone means is coupled to the connecting means by a ball joint and can be tilted in any desired plane and the actuator means are arranged symmetrically about the connecting means.

7. The apparatus of claim 1 wherein the actuators are hydraulic actuators.

8. The apparatus of claim 1 wherein the actuators are pneumatic actuators.

9. The apparatus of claim 1 wherein the actuators are electric actuators.

10. The apparatus of claim 1 wherein the nose cone means contains an angle of attack sensor means.

11. The apparatus of claim 1 wherein the nose cone means comprises a flat disk means.

12. The apparatus claim 11 comprising connecting means having first and second ends, the first end fixed to the main body at the longitudinal axis of the main body and the second end fixed to the flat disk means, connecting means comprising a circular pin means coupled to the flat disk means at the central axis of the flat disk means and a square rod means connected to the circular pin means.

13. The apparatus of claim 12 wherein the actuator means are coupled to the flat disk means by adjusting pins.

* * * * *

UNITED STATES PATENT AND TRADEMARK OFFICE

CERTIFICATE OF CORRECTION

PATENT NO. : 4,925,130

DATED : May 15, 1990

INVENTOR(S) : Walter Kranz

It is certified that error appears in the above-identified patent and that said Letters Patent is hereby corrected as shown below:

Column 1, line 34 should read -- the first correction, the missile must be rotated--

Signed and Sealed this

Fifth Day of May, 1992

*Attest:*

DOUGLAS B. COMER

*Attesting Officer*

*Acting Commissioner of Patents and Trademarks*